US006309186B1

(12) United States Patent
Lafalce et al.

(10) Patent No.: US 6,309,186 B1
(45) Date of Patent: Oct. 30, 2001

(54) AIR CONDITIONING PRESSURE RELIEF VALVE ASSEMBLY

(75) Inventors: Guy E. Lafalce, Romeo; Michael E. Lafalce, Sterling Heights, both of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/481,862

(22) Filed: Jan. 12, 2000

(51) Int. Cl.[7] ..... F04B 49/00
(52) U.S. Cl. ..... 417/307
(58) Field of Search ..... 417/307, 306, 417/311; 251/344, 345, 127, 118

(56) References Cited

U.S. PATENT DOCUMENTS 3,823,568 * 7/1974 Bijasiewicz et al. ..... 62/7
5,362,210 11/1994 Richardson .
5,800,133 * 9/1998 Ikeda et al. ..... 417/269
5,913,664 * 6/1999 Shimizu et al. ..... 417/307
5,984,645 * 11/1999 Cummings ..... 417/307

* cited by examiner

*Primary Examiner*—Teresa Walberg
*Assistant Examiner*—Vinod D. Patel
(74) *Attorney, Agent, or Firm*—Jeffrey A. Sedlar

(57) ABSTRACT

A pressure relief valve assembly for an air conditioning system of a vehicle includes a compressor hose block having an inlet port and an outlet port. The inlet port is for connection to a low pressure gas and the outlet port is for connection to high pressure gas of the air conditioning system. The compressor hose block also has a connecting port interconnecting the inlet port and the outlet port. The pressure relief valve assembly further includes a valve disposed in the connecting port to allow the high pressure gas to pass from the outlet port to the inlet port when a pressure of the high pressure gas reaches a predetermined level.

20 Claims, 2 Drawing Sheets

AIR CONDITIONING PRESSURE RELIEF VALVE ASSEMBLY

TECHNICAL FIELD

The present invention relates generally to air conditioning systems for vehicles and, more particularly, to a pressure relief valve assembly for an air conditioning system of a vehicle.

BACKGROUND OF THE INVENTION

It is known to provide an air conditioning system for a vehicle such as a pick-up truck. Typically, the air conditioning system includes a compressor, an evaporator, condenser and an accumulator or expansion valve. The air conditioning system may include an electric air conditioning compressor high pressure shut off switch or pressure transducer to control air conditioning pressures if pressure spikes occur during idle or drive-away conditions. However, these pressure spikes result in an identifiable interruption to the operator of the vehicle.

It is desirable to provide high pressure control of an air conditioning system for a vehicle. It is also desirable to eliminate air conditioning interruptions to the operator if air conditioning high pressure spikes occur during drive-away conditions. Therefore, there is a need in the art to provide a pressure relief valve assembly for an air conditioning system of a vehicle.

SUMMARY OF THE INVENTION

It is, therefore, one object of the present invention to provide a pressure relief valve assembly for an air conditioning system of a vehicle.

It is another object of the present invention to provide a high pressure gas to low pressure gas relief valve assembly for an air conditioning system.

It is yet another object of the present invention to provide an internal high pressure relief for an air conditioning system without turning off a compressor of an air conditioning system.

To achieve the foregoing objects, the present invention is a pressure relief valve assembly for an air conditioning system of a vehicle. The pressure relief valve assembly includes a compressor hose block having an inlet port and an outlet port. The inlet port is for connection to a low pressure gas and the outlet port is for connection to high pressure gas of the air conditioning system. The compressor hose block also has a connecting port interconnecting the inlet port and the outlet port. The pressure relief valve assembly further includes a valve disposed in the connecting port to allow high pressure gas to pass from the outlet port to the inlet port when the pressure of the high pressure gas reaches a predetermined level.

One advantage of the present invention is that a pressure relief valve assembly is provided for an air conditioning system of a vehicle. Another advantage of the present invention is that pressure relief valve assembly provides internal air conditioning system high pressure relief without turning off the air conditioning compressor, resulting in little or no loss in air conditioning performance during pressure reduction. Yet another advantage of the present invention is that the pressure relief valve assembly improves overall air conditioning system performance by the use of a larger diameter air conditioning inlet line (less pressure drop). Still another advantage of the present invention is that the pressure relief valve assembly enhances air conditioning performance at idle and low speeds of the vehicle by increasing air conditioning compressor to engine crank pulley ratio. A further advantage of the present invention is that the pressure relief valve assembly provides no identifiable interruptions in the air conditioning system performance to the operator of the vehicle.

Other objects, features and advantages of the present invention will be readily appreciated, as the same becomes better understood after reading the subsequent description taken in conjunction with the accompanying drawings.

DESCRIPTION OF THE PREFERRED EMBODIMENT

Figure 1:
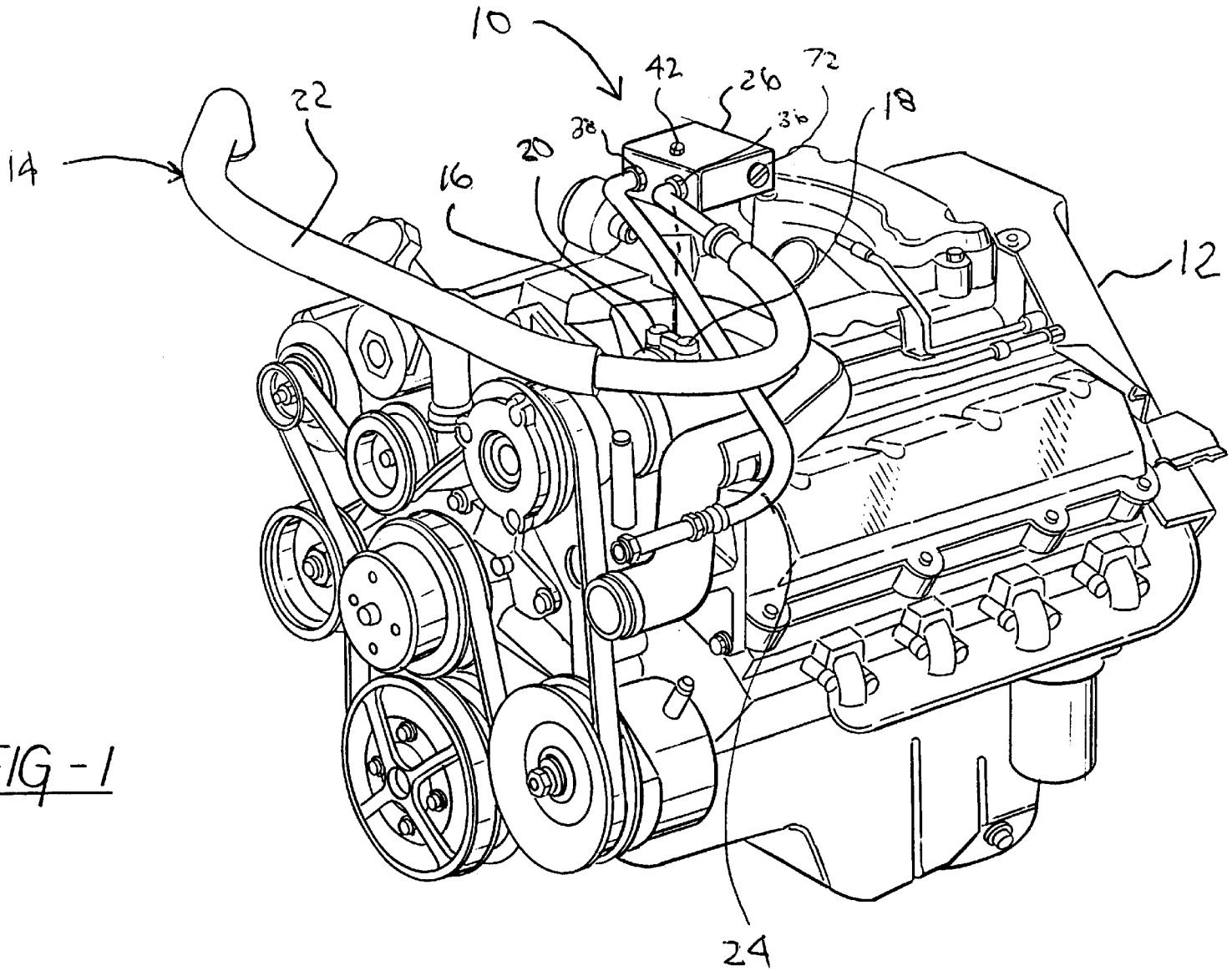
FIG. 1 is a perspective view of a pressure relief valve assembly, according to the present invention, illustrated in an exploded position with an air conditioning system of a vehicle.

Referring to the drawings and in particular FIG. 1, one embodiment of a pressure relief valve assembly 10, according to the present invention, is shown with an engine 12 for a vehicle such as a pick-up truck (not shown). The vehicle includes an air conditioning system, generally indicated at 14 and partially shown, illustrated in operational relationship with the engine 12 for providing cooling air to an occupant compartment (not shown) of the vehicle. The air conditioning system 14 includes a compressor 16 mounted to the engine 12 and having an inlet 18 and an outlet 20. The air conditioning system 14 also includes a first conduit or hose 22 having one end connected to an accumulator (not shown) of the air conditioning system 14 and another end connected to the pressure relief valve assembly to be described. The air conditioning system 14 also includes a second conduit or hose 24 having one end connected to a condenser (not shown) of the air conditioning system 14 and another end connected to the pressure relief valve assembly 10 to be described. It should be appreciated that the air conditioning system 14 includes the pressure relief valve assembly 10. It should also be appreciated that, except for the pressure relief valve assembly 10, the air conditioning system 14 and engine 12 are conventional and known in the art.

Figure 2:
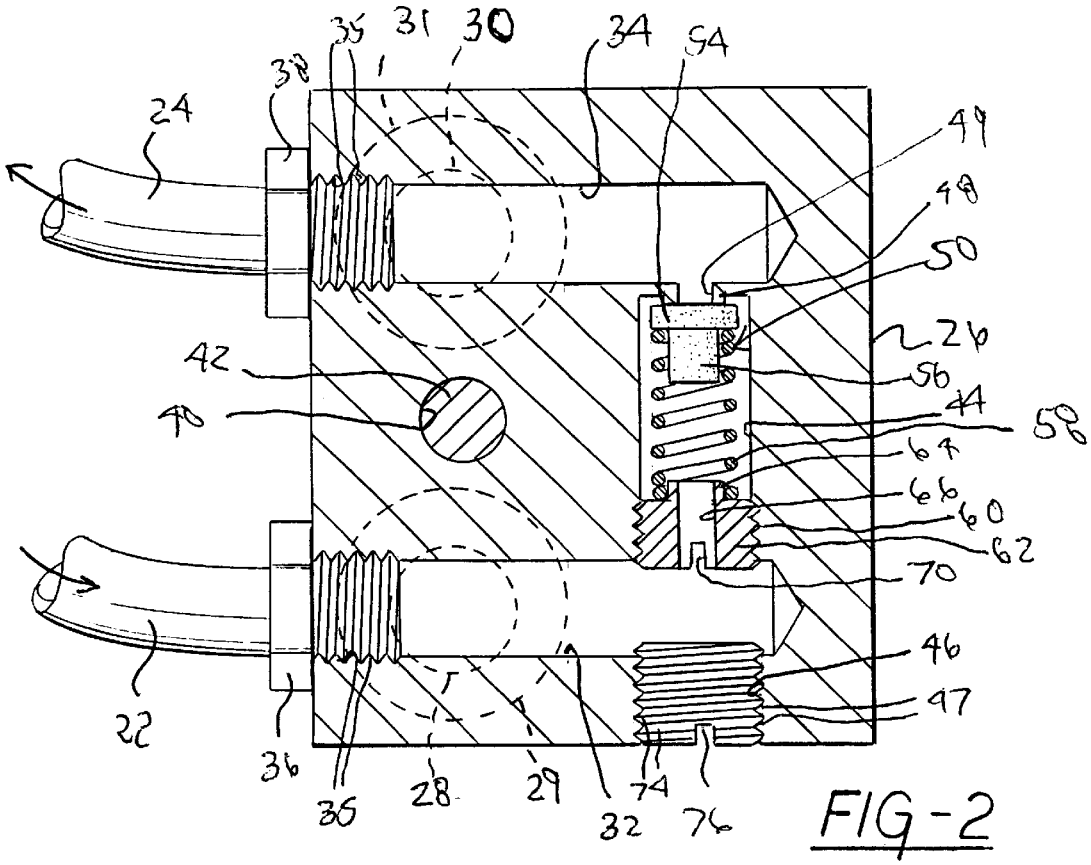
FIG. 2 is a fragmentary plan view of the pressure relief valve assembly of FIG. 1.
Figure 3:
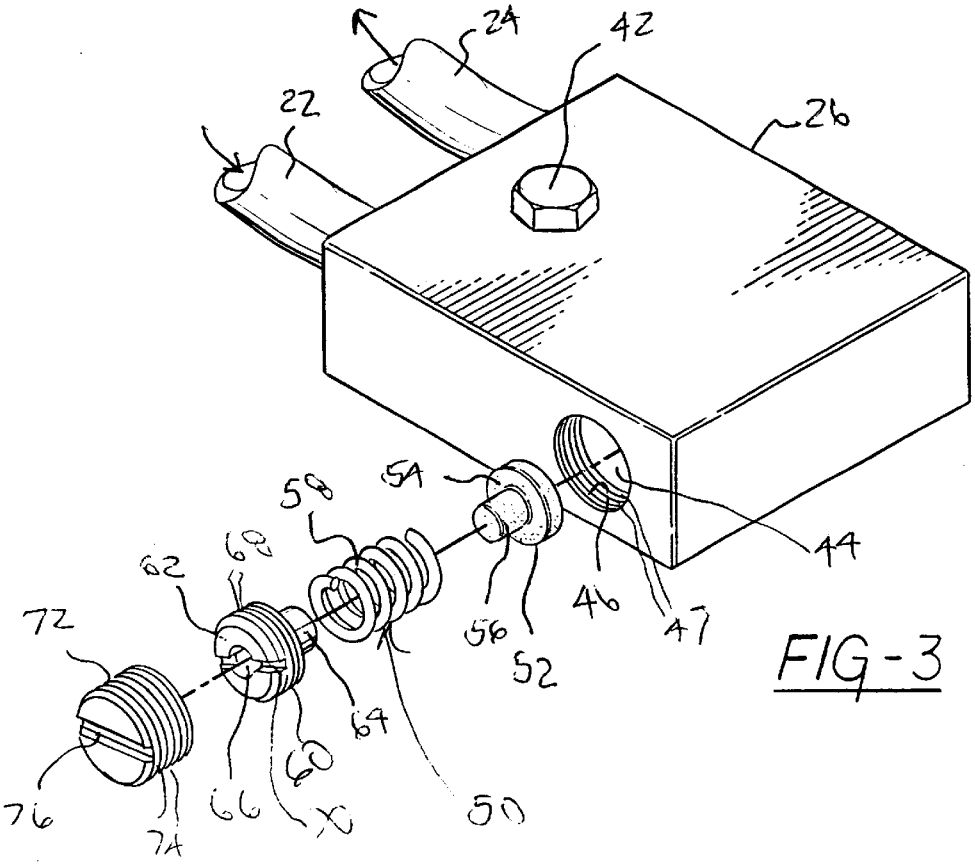
FIG. 3 is an exploded perspective view of the pressure relief valve assembly of FIG. 1.

Referring to FIGS. 1 through 3, the pressure relief valve assembly 10 includes an air conditioning compressor hose block 26. The hose block 26 is generally rectangular in shape and made of a metal material such as steel. The hose block 26 includes an inlet 28 in a bottom thereof to fluidly communicate with the inlet 18 of the compressor 16. The hose block 26 includes a raised boss 29 surrounding the inlet 28 and a projection (not shown) extending axially to be disposed in the inlet 18 for mounting to the compressor 16. The raised boss 29 and inlet 28 are generally circular in shape, but may have any suitable shape. The hose block 26 also includes an outlet 30 in a bottom thereof and spaced laterally from the inlet 28 to fluidly communicate with the outlet 20 of the compressor 16. The hose block 26 includes a raised boss 31 surrounding the outlet 30 and a projection (not shown) extending axially to be disposed in the outlet 20 for mounting to the compressor 16. The raised boss 31 and outlet 30 are generally circular in shape, but may have any suitable shape. The hose block 26 includes an inlet port 32 in a side thereof extending longitudinally and fluidly communicating with the inlet 28. The hose block 26 also includes an outlet port 34 in a side thereof spaced laterally from the inlet port 32 and extending longitudinally and fluidly communicating with the outlet 30. The inlet port 32 and outlet port 34 may include a plurality of threads 35 to receive threaded fittings 36 and 38, respectively, of the first conduit 22 and second conduit 24, respectively, to attach the conduits 22 and 24 to the hose block 26. It should be appreciated that the ports 32 and 34 may be drilled and that brazed fittings 36 and 38 may be disposed therein as opposed to a threaded connection.

The hose block 26 also includes an aperture 40 extending therethrough from a top side to the bottom side thereof to receive a fastener 42 such as a bolt to fasten the hose block 26 to the compressor 16. The hose block 16 also includes a connecting port 44 in a side thereof extending laterally and communicating with the inlet port 32 and outlet port 34. The connecting port 44 has an opening 46 and may include a plurality of threads 47 for a function to be described. The connecting port 44 has a seat 48 formed at the end opposite the opening 46 and extending axially. The seat 48 includes an aperture 49 extending axially therethrough and communicating with the outlet port 30. The aperture 49 has a diameter less than a diameter of the connecting port 44. It should be appreciated that the inlet port 28 receives low pressure fluid and outlet port 30 receives high pressure fluid of the air conditioning system 14.

The pressure relief valve assembly 10 also includes a valve, generally indicated at 50, disposed in the connecting port 44 to allow high pressure fluid to pass from the outlet port 30 to the inlet port 28 when a pressure of the high pressure gas reaches a predetermined level. The valve 50 includes a high pressure seal 52 disposed in the connecting port 44 adjacent the outlet port 34. The high pressure seal 52 is generally T shaped with a circular cross-section. The high pressure seal 52 has an enlarged head portion 54 extending radially that seats on the seat 48 to close the aperture 49 and a shaft portion 56 extending axially from the head portion 54. The pressure relief valve assembly 10 includes a calibrated pressure relief spring 58 disposed in the connecting port 44 and having one end disposed about the shaft portion 56 of the high pressure seal 52 to urge the high pressure seal 52 against the seat 48 in a closed position. The spring 58 is of a coil type and made of a metal material. The spring 58 is calibrated to compress when the pressure in the outlet port 30 reaches a predetermined level. The pressure relief valve assembly 10 includes a spring retainer 60 disposed in the connecting port 44. The spring retainer 60 is generally circular in shape and made of a metal material. The spring retainer 60 has a head portion 62 extending radially and a shaft portion 64 extending axially from the head portion 62. The other end of the spring 58 is disposed about the shaft portion 64. The spring retainer 60 has an orifice or aperture 66 extending axially therethrough. The spring retainer 60 may include a plurality of threads 68 on the head portion 62 to threadably engage the threads 47 in the opening 46 of the connecting port 44. The spring retainer 60 may include a slot 70 in the head portion 62 to allow a tool (not shown) such as a screwdriver to rotate the spring retainer 60 and compress the spring 58. The pressure relief valve assembly 10 includes a plug 72 disposed in the opening 46 of the connecting port 44. The plug 72 is generally circular in shape and may include a plurality of threads 74 to threadably engage the threads 47 of the opening 46. The plug 72 may include a slot 76 therein to allow a tool (not shown) such as a screwdriver to rotate the plug 72 and removably secure the plug 72 in the opening 46. The plug 72 is made of a metal material such as aluminum. It should be appreciated that the opening 46 of the connecting port 44 may be drilled and that a brazed plug 72 may be disposed therein as opposed to a threaded connection.

In operation of the pressure relief valve assembly 10, low pressure gas from the first conduit 22 enters the inlet port 32 and flows through the inlet 28 to the inlet 18 of the compressor 16. The compressor 16 compresses the low pressure gas, which flows out the outlet 20 of the compressor 16 and through the outlet 30 and outlet port 34 of the pressure relief valve assembly 10 to the second conduit 24. When the high pressure gas in the high side or outlet port 34 reaches a pressure level, the calibrated spring setting or force of the spring 58 allows the high pressure seal 52 to be pushed off and spaced from the seat 48 in an open position. The high pressure gas then passes around the high pressure seal 52, the spring 58 and through the orifice 66 in the spring retainer 60 and into the low pressure or inlet port 32. Once the pressure of the high pressure gas drops below the calibrated spring force, the calibrated pressure relief spring 58 forces the high pressure seal 52 back on the seat 48 and stops the flow of gas between the ports 32 and 34.

Accordingly, the pressure relief valve assembly 10 provides high pressure control between the high pressure side and the low pressure side of the air conditioning system 14. The pressure relief valve assembly 10 can be applied to most current air conditioning compressor line applications and can be implemented internally in some compressors. The pressure relief valve assembly 10 provides enhanced air conditioning performance (reduced suction pressure drop) by increasing suction line diameter and possible elimination of the air conditioning high pressure compressor cut-off switch. The pressure relief valve assembly 10 prevents air conditioning interruptions (compressor shut-off) in performance to the operator of the vehicle if air conditioning high pressure spikes occur during drive-away conditions.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A pressure relief valve assembly for an air conditioning system of a vehicle comprising:

a compressor hose block having an inlet port and an outlet port, said inlet port for connection to a low pressure gas and said outlet port for connection to high pressure gas of the air conditioning system;

said compressor hose block having a connecting port interconnecting said inlet port and said outlet port; and a valve disposed in said connecting port to allow the high pressure gas to pass from said outlet port to said inlet port when a pressure of the high pressure gas reaches a predetermined level.

2. A pressure relief valve assembly as set forth in claim 1 wherein said valve comprises a high pressure seal and a calibrated pressure relief spring to urge said high pressure seal to a closed position.

3. A pressure relief valve assembly as set forth in claim 2 wherein said calibrated pressure relief spring is a coil spring.

4. A pressure relief valve assembly as set forth in claim 2 wherein said high pressure seal has a head portion extending radially and a shaft portion extending axially, said head portion being disposed adjacent a seat and said calibrated pressure relief spring having one end disposed about said shaft portion.

5. A pressure relief valve assembly as set forth in claim 2 wherein said valve includes a spring retainer disposed in said connecting port and adjacent said calibrated pressure relief spring.

6. A pressure relief valve assembly as set forth in claim 5 wherein said spring retainer has a head portion extending radially and a shaft portion extending axially, said calibrated pressure relief spring having one end disposed about said shaft portion.

7. A pressure relief valve assembly as set forth in claim 6 wherein said connecting port has a threaded portion, said head portion being threaded to threadably engage said threaded portion.

8. A pressure relief valve assembly as set forth in claim 5 wherein said spring retainer has an orifice extending axially therethrough.

9. A pressure relief valve assembly as set forth in claim 1 wherein said valve assembly includes a plug disposed in an opening of said connecting port to retain said valve in said connecting port.

10. A pressure relief valve assembly as set forth in claim 9 wherein said opening has a plurality of first threads and said plug has a plurality of second threads to engage said first threads of said opening.

11. A pressure relief valve assembly for an air conditioning system of a vehicle comprising:

a compressor hose block having an inlet port and an outlet port, said inlet port for connection to a low pressure gas and said outlet port for connection to high pressure gas of the air conditioning system;

said compressor hose block having a connecting port interconnecting said inlet port and said outlet port and having an opening at one end and a seat at another end opposite said opening; and a high pressure seal disposed in said connecting port adjacent said seat and a calibrated pressure relief spring disposed in said connecting port adjacent said high pressure seal to urge said high pressure seal against said seat in a closed position, said high pressure seal having an open position spaced from said seat to allow the high pressure gas to pass from said outlet port to said inlet port when a pressure of the high pressure gas reaches a predetermined level.

12. A pressure relief valve assembly as set forth in claim 11 wherein said high pressure seal has a head portion extending radially and a shaft portion extending axially, said head portion being disposed adjacent said seat and said calibrated pressure relief spring having one end disposed about said shaft portion.

13. A pressure relief valve assembly as set forth in claim 11 wherein said calibrated pressure relief spring is a coil spring.

14. A pressure relief valve assembly as set forth in claim 11 wherein said valve includes a spring retainer disposed in said connecting port and adjacent said calibrated pressure relief spring.

15. A pressure relief valve assembly as set forth in claim 14 wherein said spring retainer has a head portion extending radially and a shaft portion extending axially, said calibrated pressure relief spring having one end disposed about said shaft portion.

16. A pressure relief valve assembly as set forth in claim 15 wherein said connecting port has a plurality of first threads, said head portion having a plurality of second threads to threadably engage said first threads.

17. A pressure relief valve assembly as set forth in claim 14 wherein said spring retainer has an orifice extending axially therethrough.

18. A pressure relief valve assembly as set forth in claim 17 including a plug disposed in an opening of said connecting port to retain said valve in said connecting port.

19. A pressure relief valve assembly as set forth in claim 18 wherein said opening has a plurality of first threads and said plug has a plurality of second threads to engage said first threads of said opening.

20. An air conditioning system for a vehicle comprising:

a compressor having a first inlet and a first outlet;

a compressor hose block mounted to said compressor and having a second inlet fluidly communicating with said first inlet of said compressor and a second outlet fluidly communicating with said first outlet of said compressor, an inlet port fluidly communicating with said second inlet and an outlet port fluidly communicating with said second outlet;

a first conduit for carrying a low pressure gas connected to said inlet port and a second conduit for carrying a high pressure gas connected to said outlet port;

said compressor hose block having a connecting port interconnecting said inlet port and said outlet port and having an opening at one end and a seat at another end opposite said opening; and a high pressure seal disposed in said connecting port adjacent said seat and a calibrated pressure relief spring disposed in said connecting port adjacent said high pressure seal to urge said high pressure seal against said seat in a closed position, said high pressure seal having an open position spaced from said seat to allow the high pressure gas to pass from said outlet port to said inlet port when a pressure of the high pressure gas reaches a predetermined level.

* * * * *